US010758795B2

(12) United States Patent
Choi

(10) Patent No.: US 10,758,795 B2
(45) Date of Patent: Sep. 1, 2020

(54) GOLF BALL MARKER HAVING CLIP PART

(71) Applicant: Yong Sik Choi, Siheung-si (KR)

(72) Inventor: Yong Sik Choi, Siheung-si (KR)

( * ) Notice: Subject to any disclaimer, the term of this patent is extended or adjusted under 35 U.S.C. 154(b) by 0 days.

(21) Appl. No.: 16/319,263

(22) PCT Filed: Jul. 18, 2017

(86) PCT No.: PCT/KR2017/007743
§ 371 (c)(1),
(2) Date: Apr. 4, 2019

(87) PCT Pub. No.: WO2018/016859
PCT Pub. Date: Jan. 25, 2018

(65) Prior Publication Data

US 2019/0262679 A1 Aug. 29, 2019

(30) Foreign Application Priority Data

Jul. 19, 2016 (KR) ..... 10-2016-0091375

(51) Int. Cl.
*A63B 57/30* (2015.01)
*A63B 57/20* (2015.01)
(Continued)

(52) U.S. Cl.
CPC ..... *A63B 57/353* (2015.10); *A45D 8/14* (2013.01); *A45F 5/02* (2013.01); *A63B 57/207* (2015.10);
(Continued)

(58) Field of Classification Search
CPC ..... A63B 57/353; A63B 57/30; A63B 57/50; A63B 57/207; A63B 2220/20;
(Continued)

(56) References Cited

U.S. PATENT DOCUMENTS 1,450,239 A * 4/1923 Bechtold ..... A45D 8/14 132/281
2,795,233 A * 6/1957 Zore ..... A45D 8/14 132/276
(Continued)

FOREIGN PATENT DOCUMENTS

JP 47-7092 U 9/1972
JP 06-000301 U 1/1994
(Continued)

OTHER PUBLICATIONS

International Search Report of corresponding Patent Application No. PCT/KR2017/007743—4 pages (dated Oct. 26, 2017).
(Continued)

*Primary Examiner* — Steven B Wong
(74) *Attorney, Agent, or Firm* — Knobbe Martens Olson & Bear LLP

(57) ABSTRACT

Disclosed is a golf ball marker having a clip part. The golf ball marker includes: a clip part including a curved elastic body elastically deformed while a curved shape thereof is reversed in response to an external force applied thereto, and a pressing piece connected to an end of the curved elastic body to be spaced apart from the curved elastic body or to come into compressive contact with the curved elastic body, the clip part being selectively attached to/detached from a pocket, a belt, a visor or head and used as a marker; and a fixing portion protruding from one side of the clip part to fix the clip part to a ground of a golf course.

13 Claims, 13 Drawing Sheets

(51) Int. Cl.
*A45D 8/14* (2006.01)
*A45F 5/02* (2006.01)

(52) U.S. Cl.
CPC ..... *A63B 57/30* (2015.10); *A63B 2207/02* (2013.01); *A63B 2209/08* (2013.01); *A63B 2220/20* (2013.01)

(58) Field of Classification Search
CPC ..... A63B 2209/08; A63B 2207/02; A63B 2102/32; A63B 2209/00; A45F 5/02; A45D 8/14
USPC ..... 473/406, 407
See application file for complete search history.

(56) References Cited

U.S. PATENT DOCUMENTS 3,316,921 A * 5/1967 Westburg ..... A45D 8/14 132/284
4,475,676 A * 10/1984 Smith ..... A45F 5/02 224/247
5,305,999 A * 4/1994 Tate ..... A63B 57/207 473/406
5,476,258 A 12/1995 Frisone
5,909,735 A * 6/1999 Knudsen ..... A24F 13/22 131/257
6,022,280 A * 2/2000 Arenburg ..... A24F 13/22 473/408
6,363,941 B1 * 4/2002 Combs ..... A24F 13/22 131/187
6,569,039 B1 * 5/2003 Cope ..... A63B 57/353 473/406
6,694,526 B1 * 2/2004 Tate ..... A42B 1/24 2/209.12
7,226,370 B1 * 6/2007 Cope ..... A63B 57/207 473/406
7,922,605 B2 * 4/2011 Lim ..... A63B 57/353 473/406
8,439,768 B1 * 5/2013 Shah ..... A24F 13/22 131/257
9,480,320 B1 * 11/2016 Pazdra ..... A45D 8/00
2002/0034992 A1 * 3/2002 Tate ..... A63B 57/353 473/406
2003/0221700 A1 * 12/2003 La Fauci ..... A45D 8/00 132/276
2004/0248674 A1 12/2004 Bauley et al.
2010/0051046 A1 * 3/2010 Stevenson ..... A45D 8/14 132/275
2014/0295998 A1 10/2014 Gilbert
2017/0224079 A1 * 8/2017 Egner ..... A45D 8/14

FOREIGN PATENT DOCUMENTS

JP 3101456 U 6/2004
JP 2008-000439 A 1/2008
JP 10-2012-0025115 A 3/2012
JP 4991615 B2 8/2012
JP 3178940 U 10/2012
JP 3184547 U 7/2013
JP 2015-39388 A 3/2015
JP 2016-106816 A 6/2016
KR 20-0412073 Y1 3/2006
KR 2012027701 A * 3/2012
KR 10-2014-0091244 A 7/2014
KR 2019071421 A * 6/2019
WO WO-0215739 A1 * 2/2002 ..... A42B 1/24

OTHER PUBLICATIONS

International Search Report of corresponding PCT Application No. PCT/KR2017/007743—2 pages (Oct. 26, 2017).
Office Action of corresponding Korean Patent Application No. 10-2016-0091375—14 pages (Sep. 1, 2017).
Office Action of corresponding Japanese Patent Application No. 2019-524102—12 pages (Feb. 3, 2020).
Extended European Search Report of corresponding European Patent Application No. 17831332.6—7 pages, (Feb. 12, 2020).

* cited by examiner

GOLF BALL MARKER HAVING CLIP PART

TECHNICAL FIELD

The present disclosure relates to a golf ball marker having a clip part, and more particularly, to a golf ball marker, which is configured in a clip shape to be capable of being selectively attached to/detached from a pocket, a belt, a visor, or head, and which is capable of indicating the position of a golf ball upon being fixed to the ground of a golf course.

BACKGROUND ART

When enjoying golf at a field golf course, players hit a golf ball from a tee box or fairway to land upon a green with a hole cup. When several players play on the green landed thereby, each golf player indicates the position of his/her golf ball to be putted by placing a golf ball marker at the green position where the golf ball has been landed such that the golf ball normally does not interfere with the other players' putting.

Such golf ball markers are generally manufactured in the form of coins, but there is a problem in that the golf ball markers may not be easily recognized on an inclined green or at the opposite side with respect to the hole cup due to the relatively thin thickness thereof.

In order to solve such a problem, Korean Patent No. 10-1042518 (published on Jun. 17, 2011) discloses a technique for golf ball markers. The prior art golf ball marker includes a plate-shaped body having a predetermined thickness, a direction-indicating needle hinged at one end thereof to the upper portion of the body to indicate the direction of the hole cup from a position where the ball is placed, a pivot member that allows the direction-indicating needle to be pivotally coupled to the body, and a weight member coupled to the lower portion of the body via multiple support pins to support the ball marker such that the ball marker does not move when the ball marker is placed on the green. The golf ball marker having such a configuration is advantageous in that the golf ball marker is able to accurately indicate the direction from the golf ball placed on the green to the hole cup, allows a situation such as a green slope to be quickly grasped, and is easily visible even from the opposite side with respect to the hole cup.

However, the golf ball marker proposed in this prior art still requires improvement in terms of the following points, and constant development is demanded.

For example, the weight itself for preventing movement on the green has an advantage in preventing movement, but is accompanied by a disadvantage in carrying due to its heavy weight. Further, the golf ball marker is poor in the convenience of carrying and use since the golf ball marker is not provided with a structure or configuration that allows the golf ball marker to be easily fixed to a user's body, clothes, or a bag or to be easily detached for use.

In addition, the structure in which the direction-indicating needle pivots upwards with respect to the body is improved in visibility compared with the conventional thin coin type golf ball marker in that it can be confirmed from anywhere on the green. However, when the amount of sunshine is small, for example, on a cloudy day, early morning, or sunset, the golf ball marker is also difficult to recognize like the prior art golf ball marker, and thus a structural improvement or a configuration addition to secure visibility is required.

DETAILED DESCRIPTION OF THE INVENTION

Technical Problem

An aspect of the present disclosure is to provide a golf ball marker with a clip part, which is configured to be easily and quickly attachable to/detachable from a body, clothes, or a bag and in which the longitudinal direction of the golf ball marker is capable of being firmly and easily installed and fixed in the vertical or horizontal direction with respect to the ground of a golf course and the visibility of the golf ball marker is capable of being further enhanced at a position where the position of the golf ball is indicated.

Technical Solution

In view of the above, a golf ball marker may include: a clip part including a curved elastic body elastically deformed while a curved shape thereof is reversed in response to an external force applied thereto, and a pressing piece connected to an end of the curved elastic body to be spaced apart from the curved elastic body or to come into compressive contact with the curved elastic body, the clip part being selectively attached to or detached from a fixed portion and being used as a marker; and a fixing portion protruding from one side of the clip part to fix the clip part to a ground of a golf course.

The curved elastic body may include a pair of elastic pieces disposed to be spaced apart from each other to form a hollow portion therebetween, the pair of elastic pieces joining at at least one end thereof in a twisted state to form a curved shape.

The fixing portion may be configured such that: at least one fixing portion protrudes outwards from a connection portion between the curved elastic body and the pressing piece in a longitudinal direction of the clip part such that the clip part is installed and fixed in a vertical direction with respect to the ground of the golf course; or at least one fixing portion protrudes from the pressing piece in a vertical direction with respect to a longitudinal direction of the clip part such that the clip part is installed and fixed in a horizontal direction with respect to the ground of the golf course.

An indication part may be coupled to the curved elastic body of the clip part to improve visibility of the clip part installed on the ground of the golf course to indicate a position of a golf ball, and the indication part may be formed in a character shape obtained by representing an insect such as a butterfly or an animal.

The indication part may have an LED lamp mounted on one side thereof.

A golf ball marker may include: a clip part including a curved elastic body elastically deformed while a curved shape thereof is reversed in response to an external force applied thereto, and a pressing piece connected to an end of the curved elastic body to be spaced apart from the curved elastic body or to come into compressive contact with the curved elastic body, the clip part being selectively attached to or detached from a fixed portion and being used as a marker; and a coin-shaped indication part provided on the clip part to improve visibility of the clip part installed on the ground of the golf course to indicate a position of a golf ball.

The curved elastic body may include a pair of elastic pieces disposed to be spaced apart from each other to form a hollow portion therebetween, the pair of elastic pieces joining at at least one end thereof in a twisted state to form a curved shape.

The fixing portion may be configured such that: at least one fixing portion protrudes outwards from an outer peripheral surface of the indication part in a longitudinal direction of the clip part such that the clip part is installed and fixed in a vertical direction with respect to the ground of the golf course; or at least one fixing portion protrudes from the bottom surface of the indication part in a vertical direction with respect to a longitudinal direction of the clip part such that the clip part is installed and fixed in a horizontal direction with respect to the ground of the golf course.

The indication part may have an LED lamp mounted on one side thereof.

The golf ball marker may further include a bottom support detachably coupled to the indication part. The bottom support may include: a body having an accommodation groove formed to pivotally accommodate the indication part therein; stroke scales formed on a top surface of the body along an edge of the accommodation groove in order to indicate a rotation degree of the clip part with respect to a hole cup in a state in which the clip part is positioned to indicate a stroke direction of a putter determined depending on a lie of a green of the golf course; and a magnetic body embedded in a center of the accommodation groove to fix the indication part with a magnetic force.

The body may further include an inclined direction indication part on the top surface thereof so as to allow an inclined direction of the green to be intuitively recognized, and the inclined direction indication part may include an annular groove formed in a ring shape along an edge of the accommodation groove in a state of being opened upwards, and a luminous ball configured to move due to its own weight in a state of being accommodated in the annular groove and to indicate the inclined direction.

The elastic pieces may have distance measurement scales formed on a surface thereof, so that a user is able to measure a distance to the hole cup based on a size of a hole cup flag when the user looks at the hole cup flag through the hollow portion at a middle or long distance.

The indication part may have a distance measurement sensor mounted on one side thereof so as to allow a distance to a hole cup within a short distance to be easily determined, and the LED lamp may change the color thereof depending on the distance to the hole cup in cooperation with the distance measurement sensor.

The clip part may include at least one of a first hole cup sight having protrusions repeatedly protruding from an elastic piece along a longitudinal direction thereof towards the hollow portion so as to set a putting line depending on a hole cup number determined depending on a lie of a green of the golf course, and a second hole cup sight having circular, elliptical, or polygonal perforations arranged at equal intervals in a central portion of the pressing piece in a longitudinal direction thereof.

Advantageous Effects

According to the present disclosure, since a clip part is provided to be capable of being easily and quickly attached to and detached from a fixed portion such as a pocket, a belt, a visor, or head, and the clip part itself has a function as a golf ball marker that is capable of being used for indicating the position of a golf ball by itself, the convenience in carrying and use can be improved.

In addition, since the clip part is firmly and easily fixed such that the longitudinal direction thereof is oriented in the vertical direction as well as the horizontal direction with respect to the ground of the golf course, it is possible to improve the visibility of the position of the golf ball even at a long distance. Furthermore, when an indication part having a creative character shape is coupled to the clip part, there is an effect that the visibility is further improved with the discrimination.

Accordingly, the user is able to solve the inconvenience of walking back and forth in order to confirm the position of the golf ball, and it is possible to easily grasp the slope or lie of the green in golf rounding in which immediate determination is important. Therefore, it is possible to promote the convenience in rounding and the improvement in athletic performance.

DESCRIPTIONS OF REFERENCE NUMERALS OF DRAWINGS

10: hole cup, 11: hole cup flag,

100: golf ball marker having a clip part according to a first embodiment of the present disclosure,

200: golf ball marker having a clip part according to a second embodiment of the present disclosure,

110, 210: clip part, 112, 212: curved elastic body, 112*a*, 112*b*, 212*a*, 212*b*: elastic piece, 114, 214: pressing piece,

114*a*: bent portion, 116: connection portion,

118, 218: distance measurement scale, 120*a*, 120*b*, 220*a*, 220*b*: fixing portion,

130, 230: indication part, 132, 232: LED lamp, 134, 234: mercury battery, 136, 236: on/off switch,

238: distance measurement sensor, 240: bottom support,

242: body, 242*a*: accommodation groove,

244: stroke scale, 244*a*: hole cup scale,

246: magnetic body, 250: inclined direction indication part,

252: annular groove, 254: luminous ball

MODE FOR CARRYING OUT THE INVENTION

Hereinafter, exemplary embodiments of the present disclosure will be described in detail with reference to the accompanying drawings. In the description of the present disclosure, the description of the well-known function or structure will be omitted in order to clear the subject matter of the present disclosure.

Figure 1A:
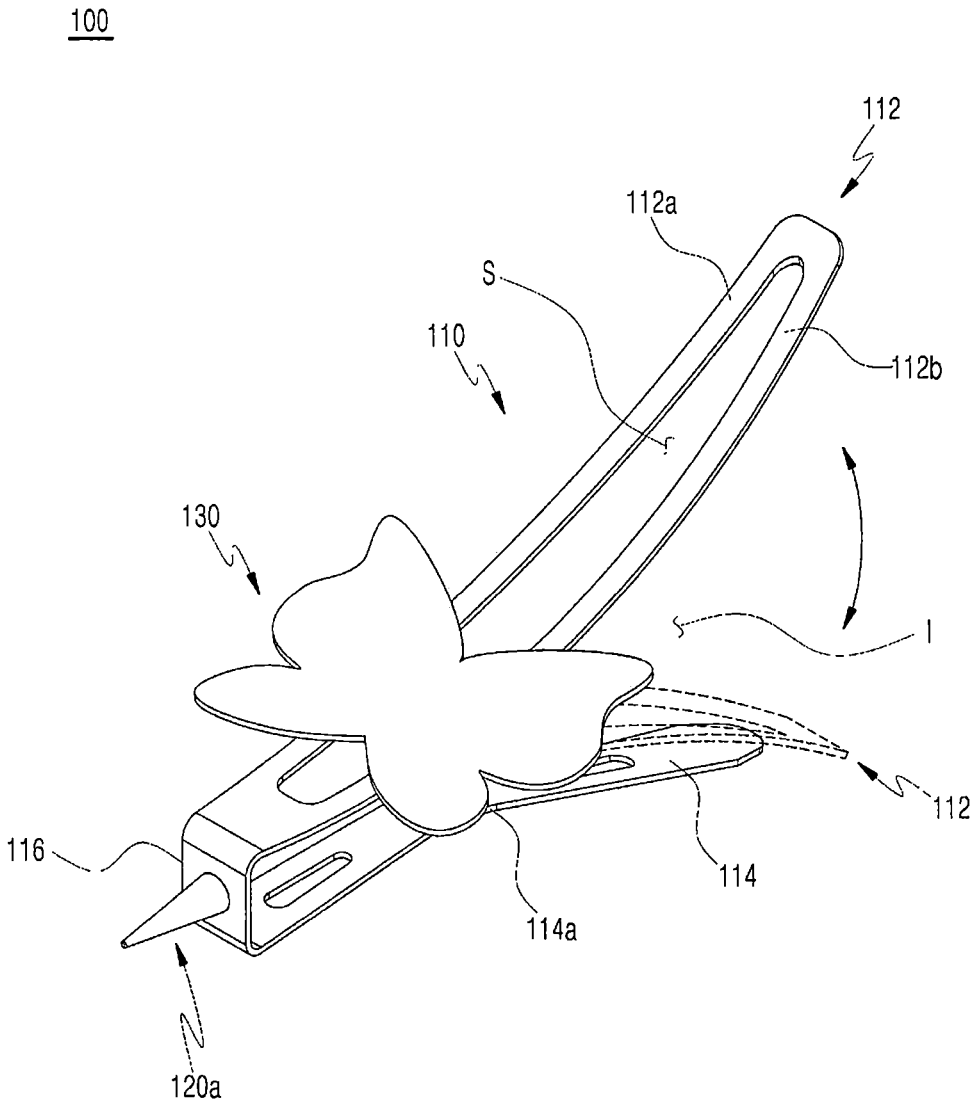
FIG. 1A is a perspective view of a golf ball marker having a clip part according to a first embodiment of the present disclosure.
Figure 1B:
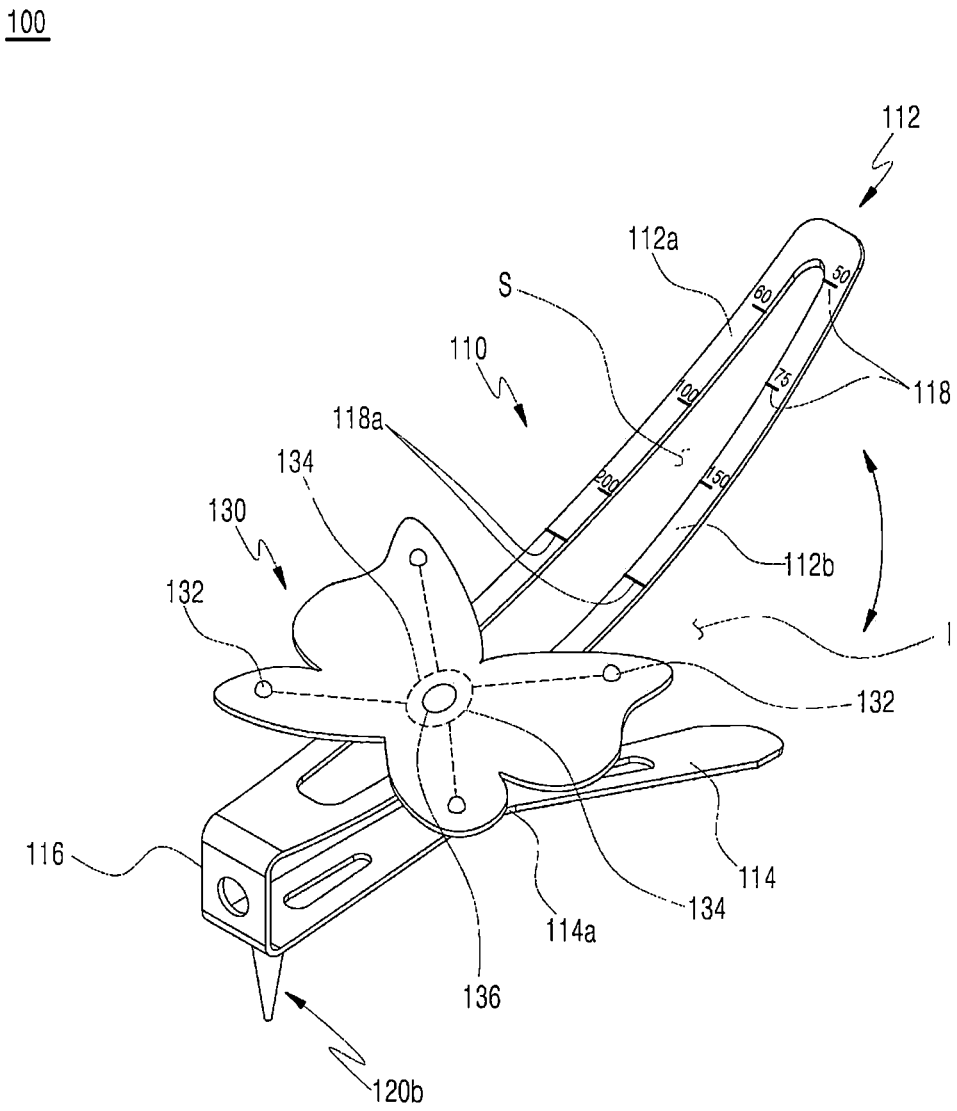
FIG. 1B is a perspective view of a first modification of the golf ball marker of FIG. 1A.
Figure 1C:
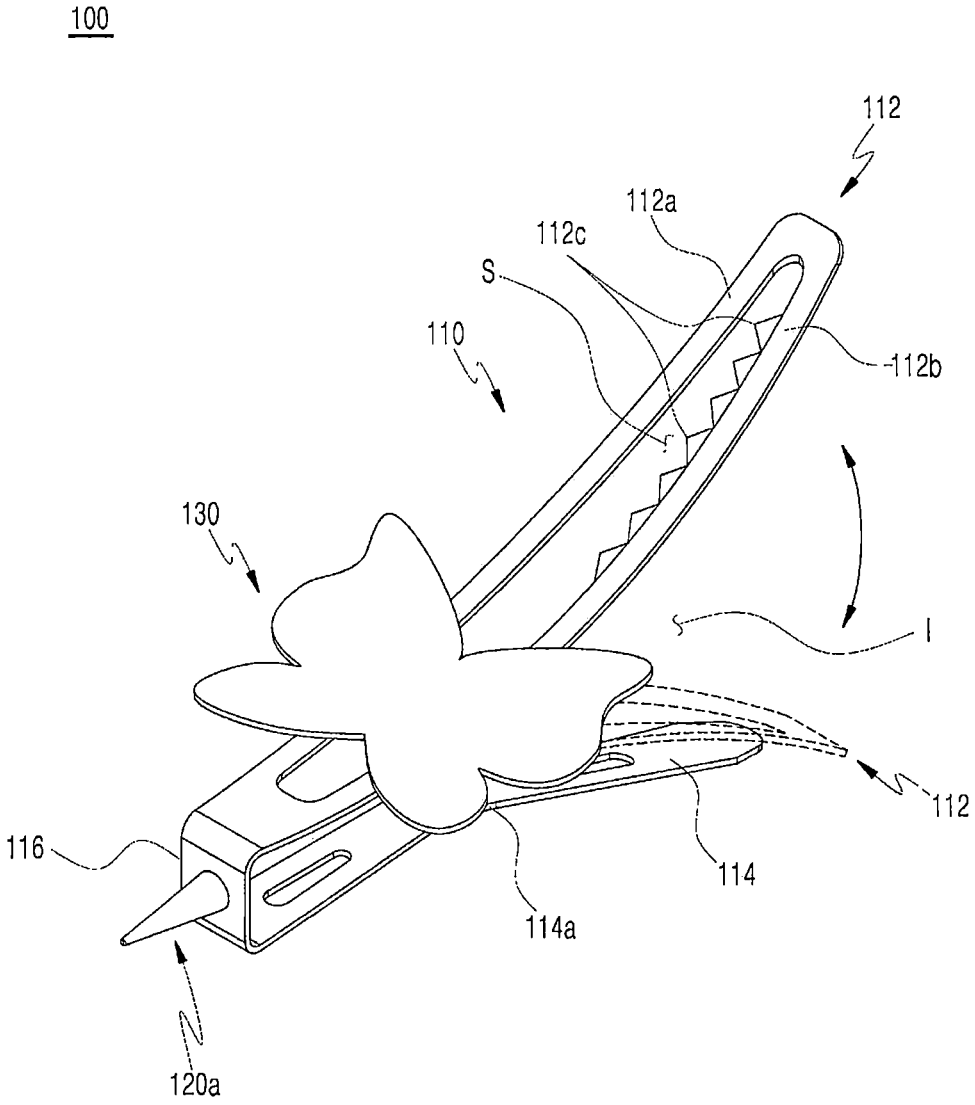
FIG. 1C is a perspective view of a second modification of the golf ball marker of FIG. 1A.
Figure 2A:
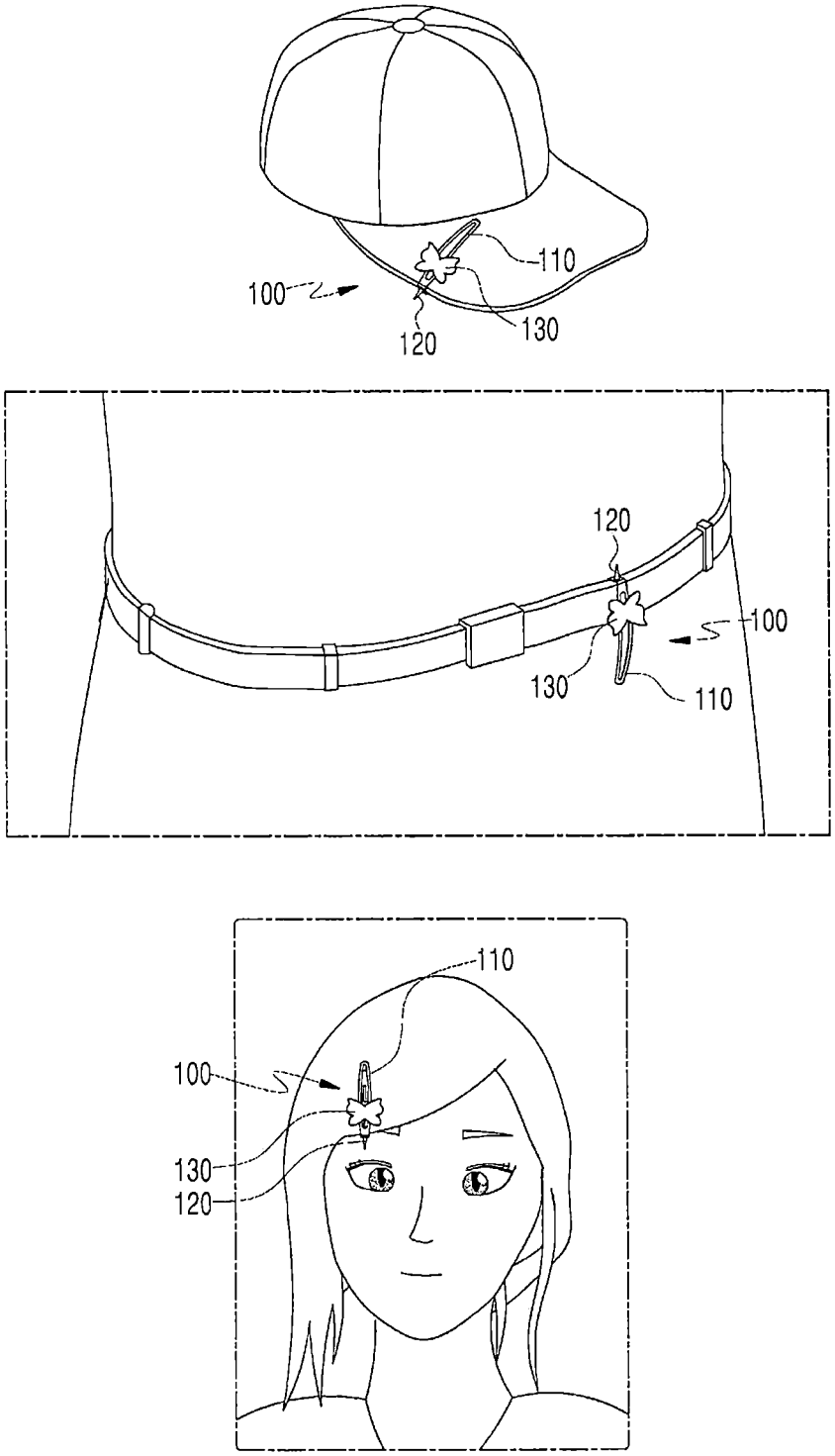
FIG. 2A illustrates states in which the golf ball marker of FIG. 1A is worn.
Figure 2B:
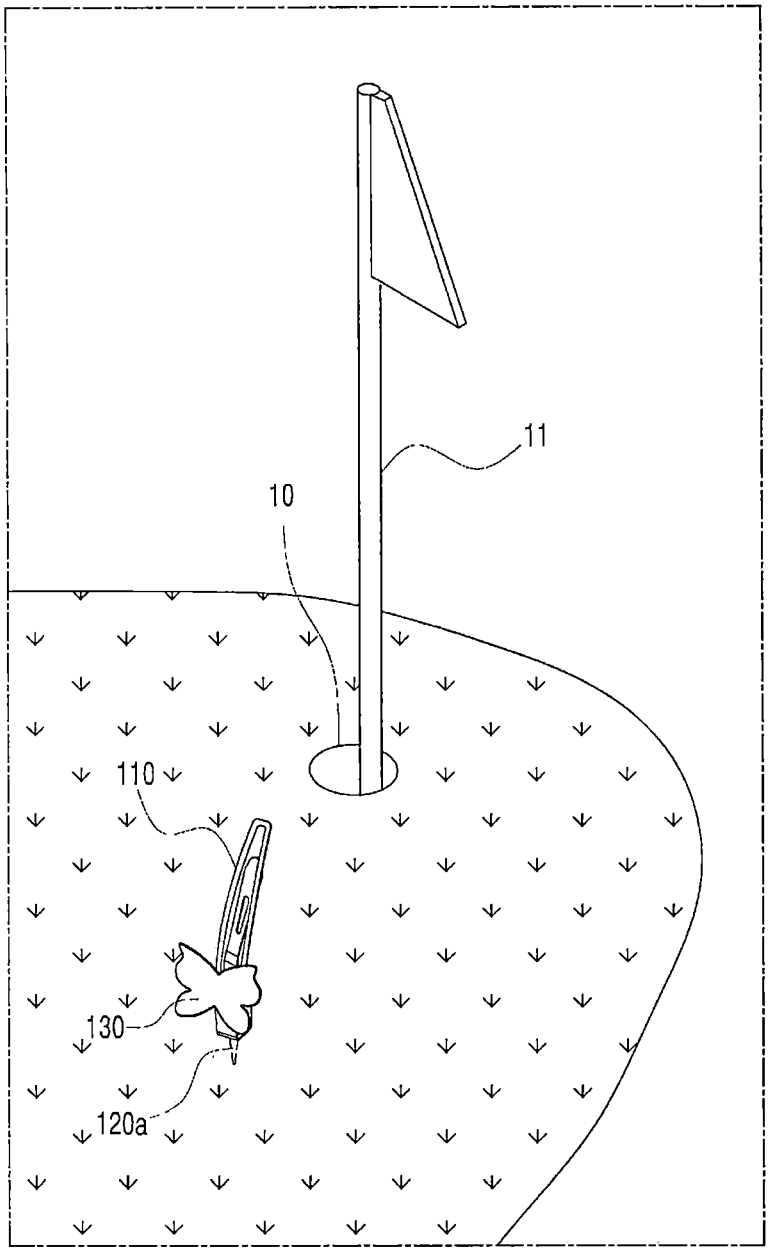
FIG. 2B is a view illustrating the state in which the golf ball marker of FIG. 1A is installed and fixed in the vertical direction with respect to a green.
Figure 3A:
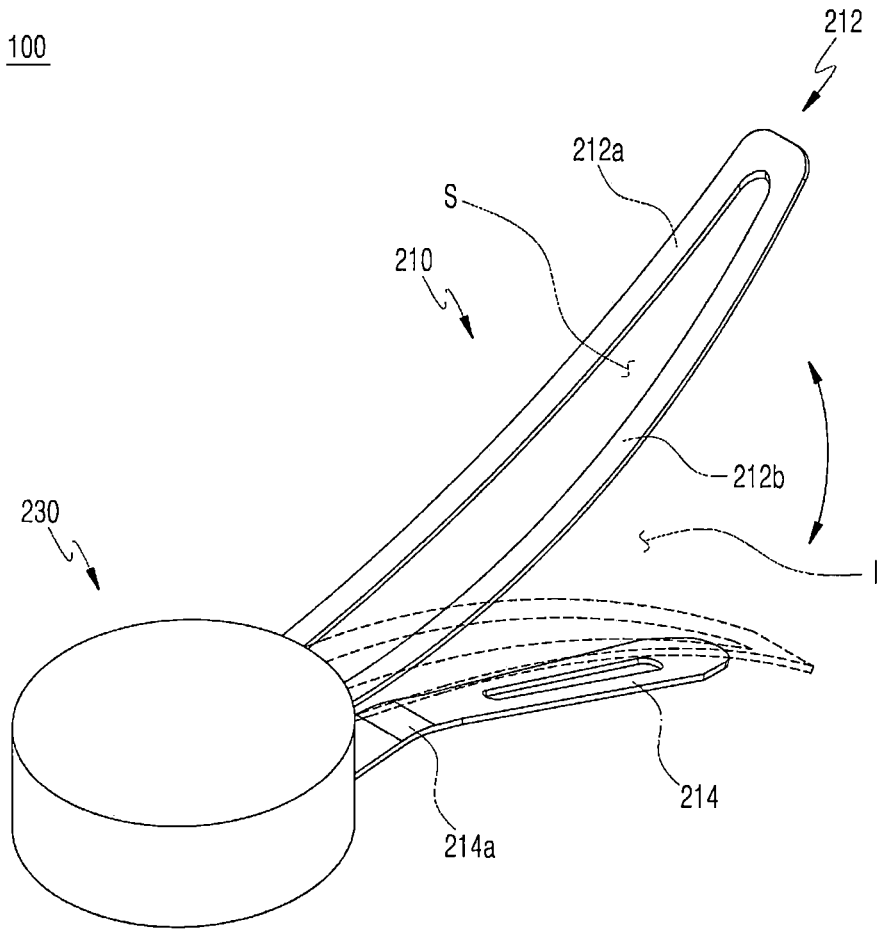
FIG. 3A is a perspective view of a golf ball marker having a clip part according to a second embodiment of the present disclosure.
Figure 3B:
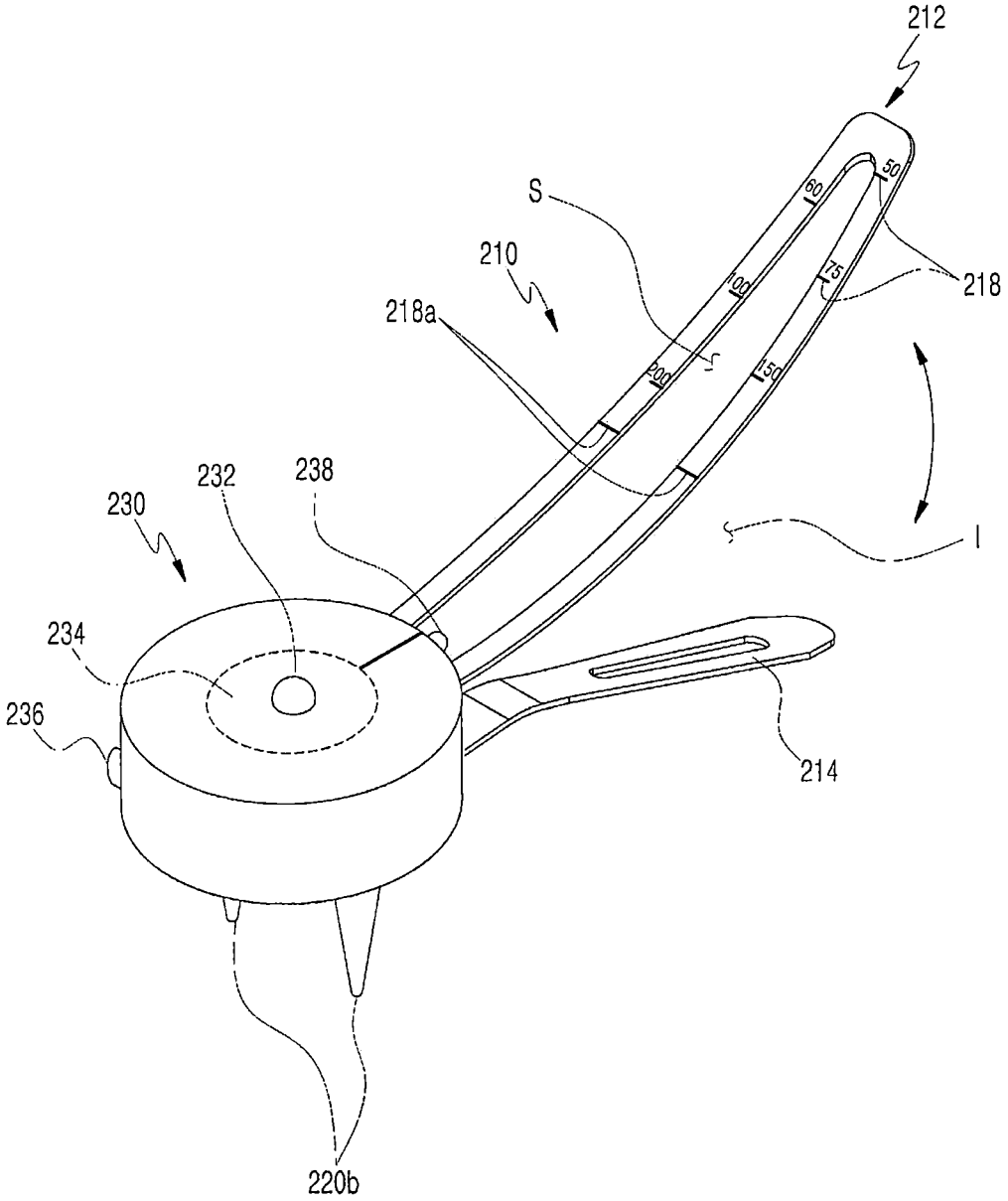
FIG. 3B is a perspective view of a first modification of the golf ball marker of FIG. 3A.
Figure 3C:
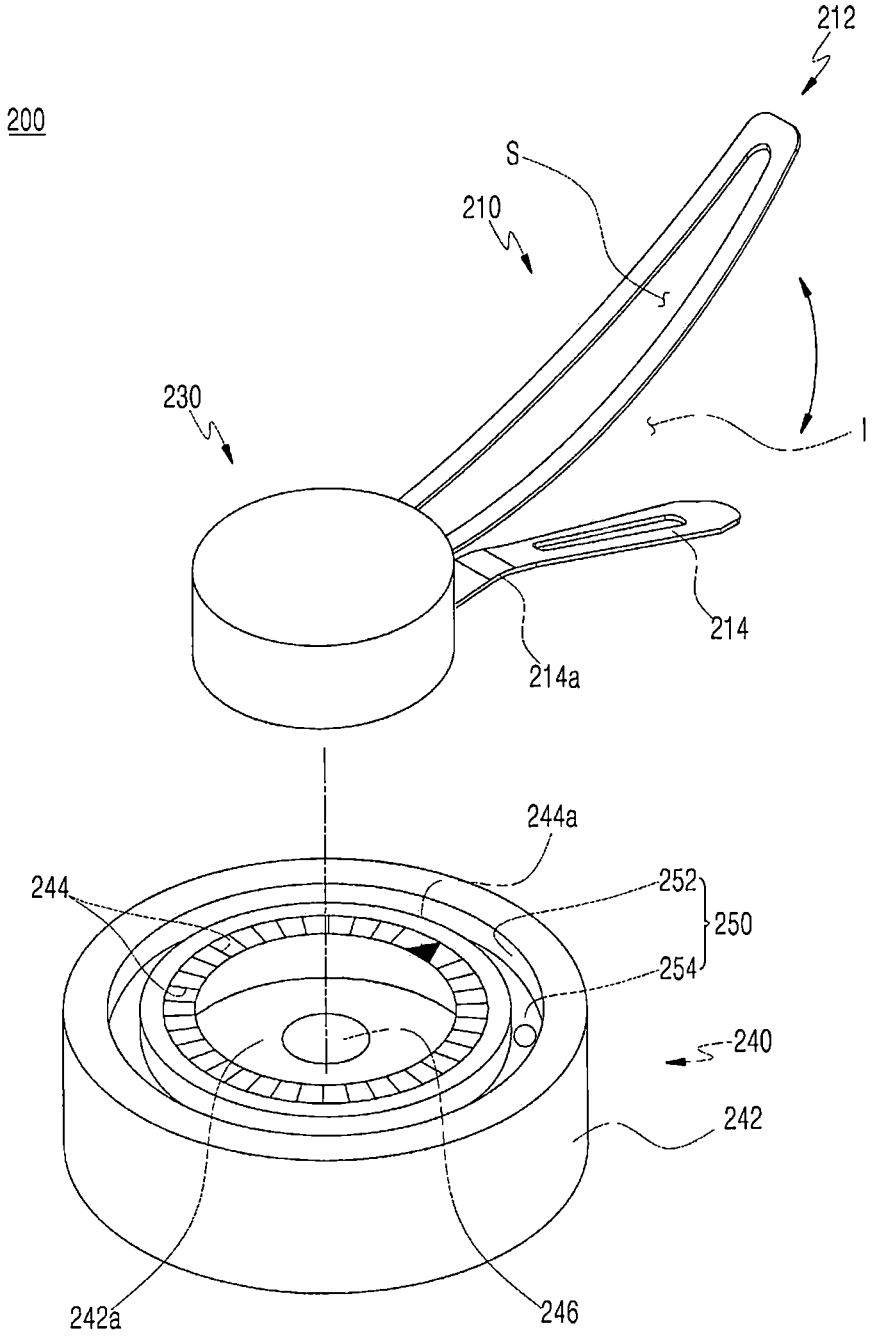
FIG. 3C is a perspective view of a second modification of the golf ball marker of FIG. 3A.
Figure 3D:
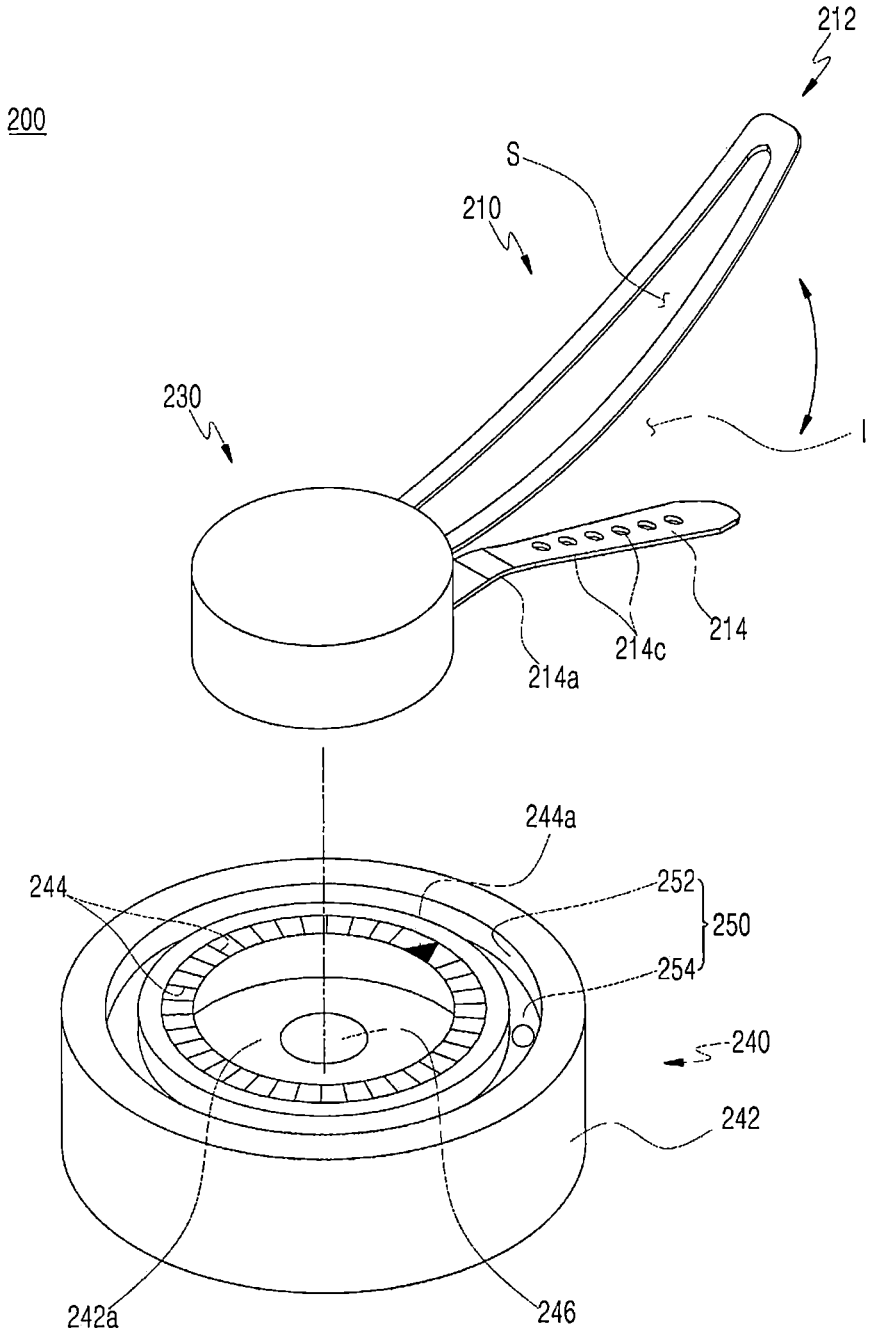
FIG. 3D is a perspective view of a third modification of the golf ball marker of FIG. 3A.
Figure 4:
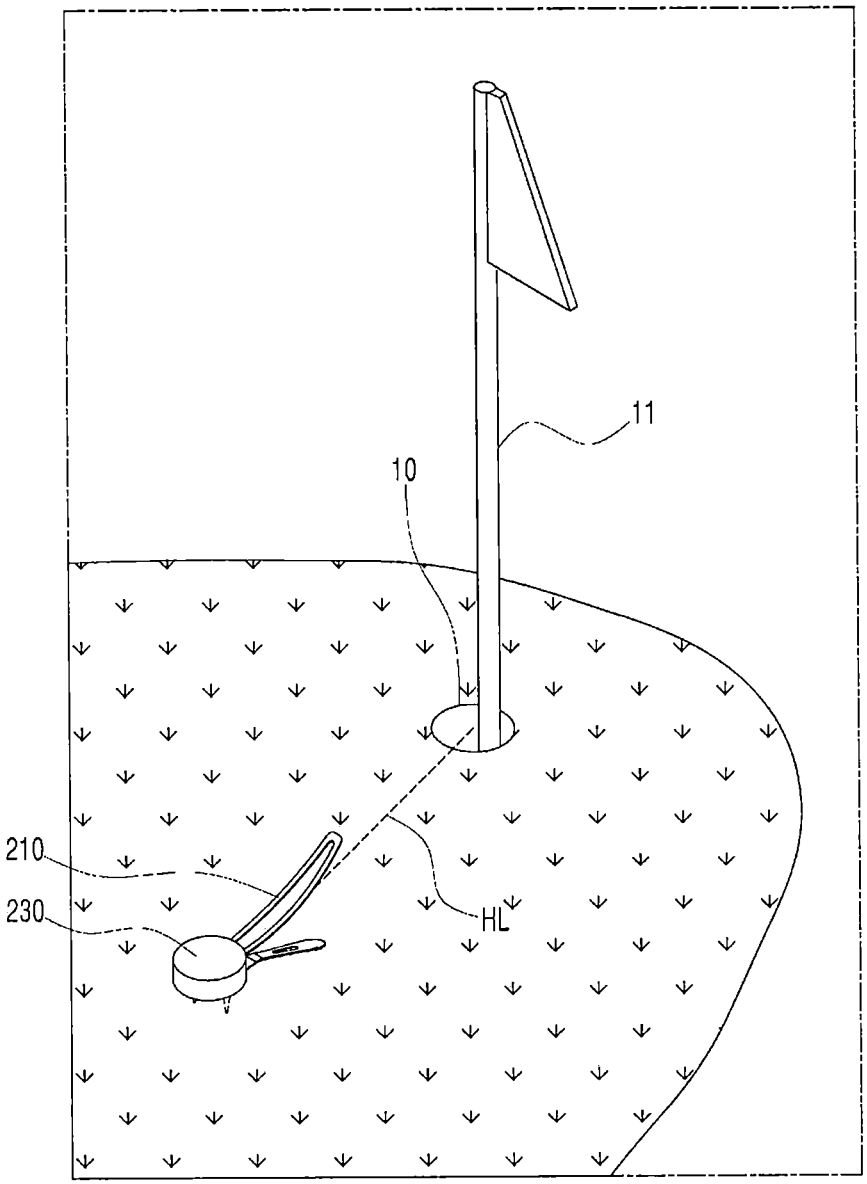
FIG. 4 is a view illustrating the state in which the golf ball marker of FIG. 3A is used in a green.
Figure 5:
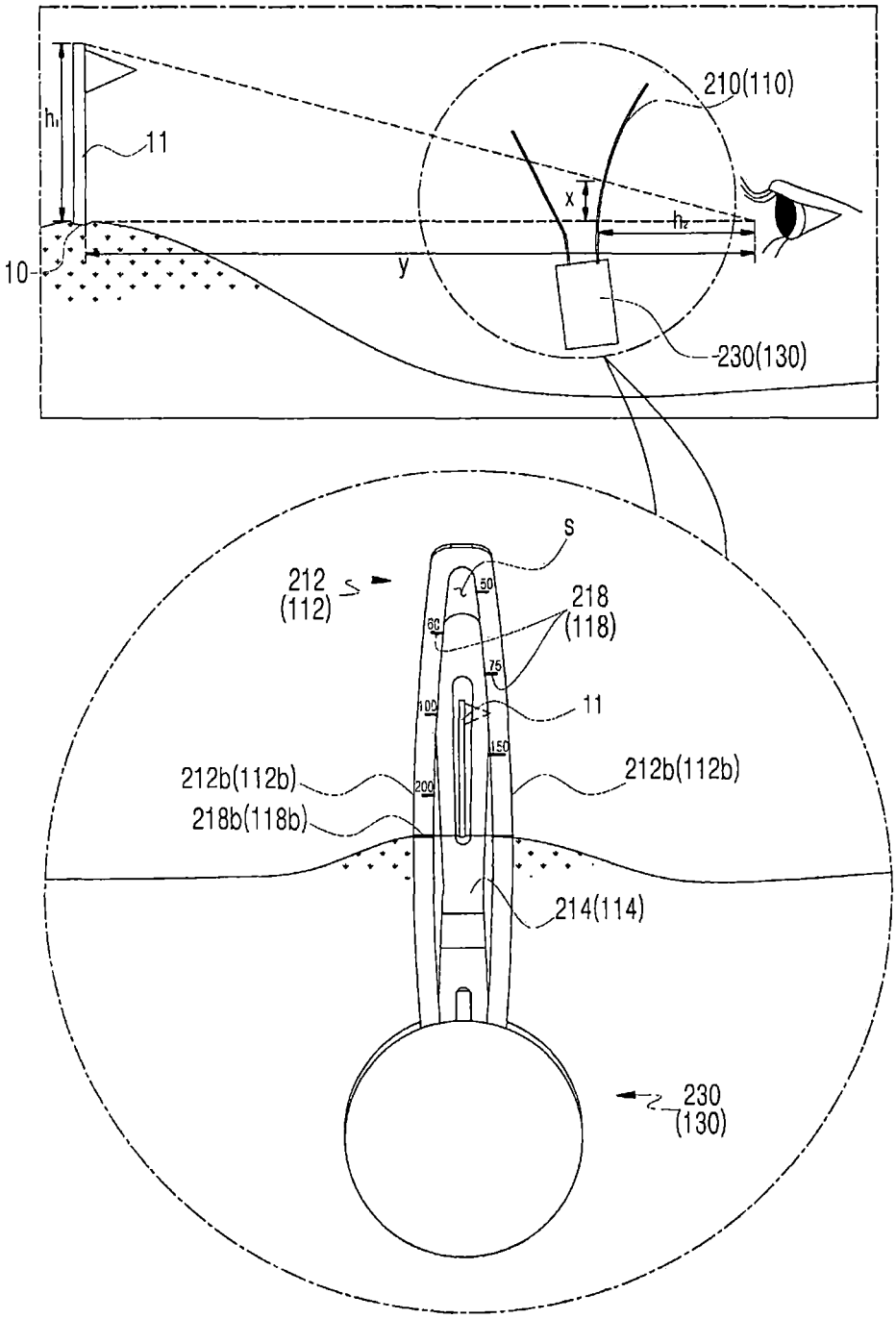
FIG. 5 is a view illustrating the state in which a distance to a hole cup is roughly measured using the golf ball marker of FIG. 3B.
Figure 6:
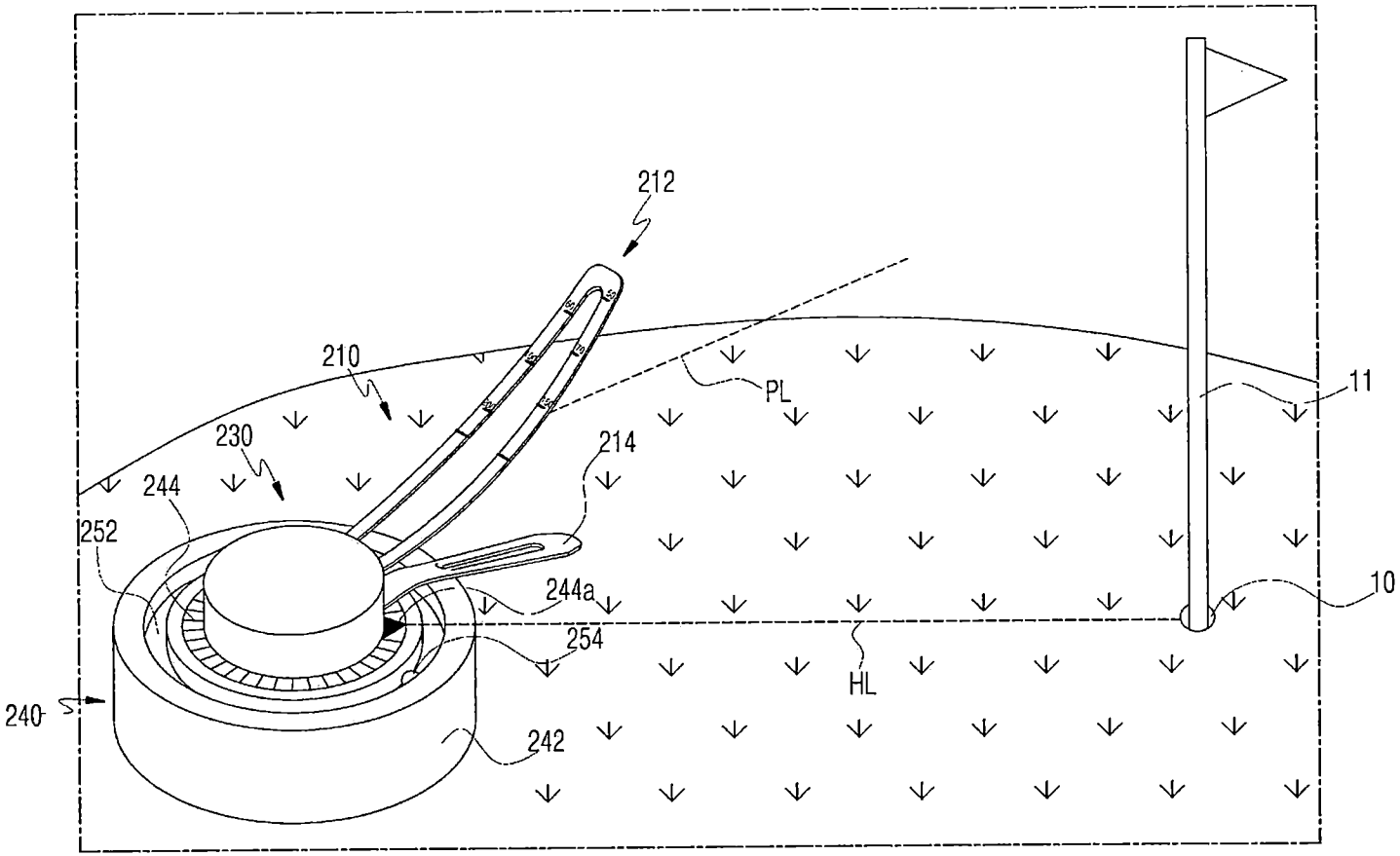
FIG. 6 is a view illustrating the state in which the golf ball marker of FIG. 3C is used in a green.
Figure 7:
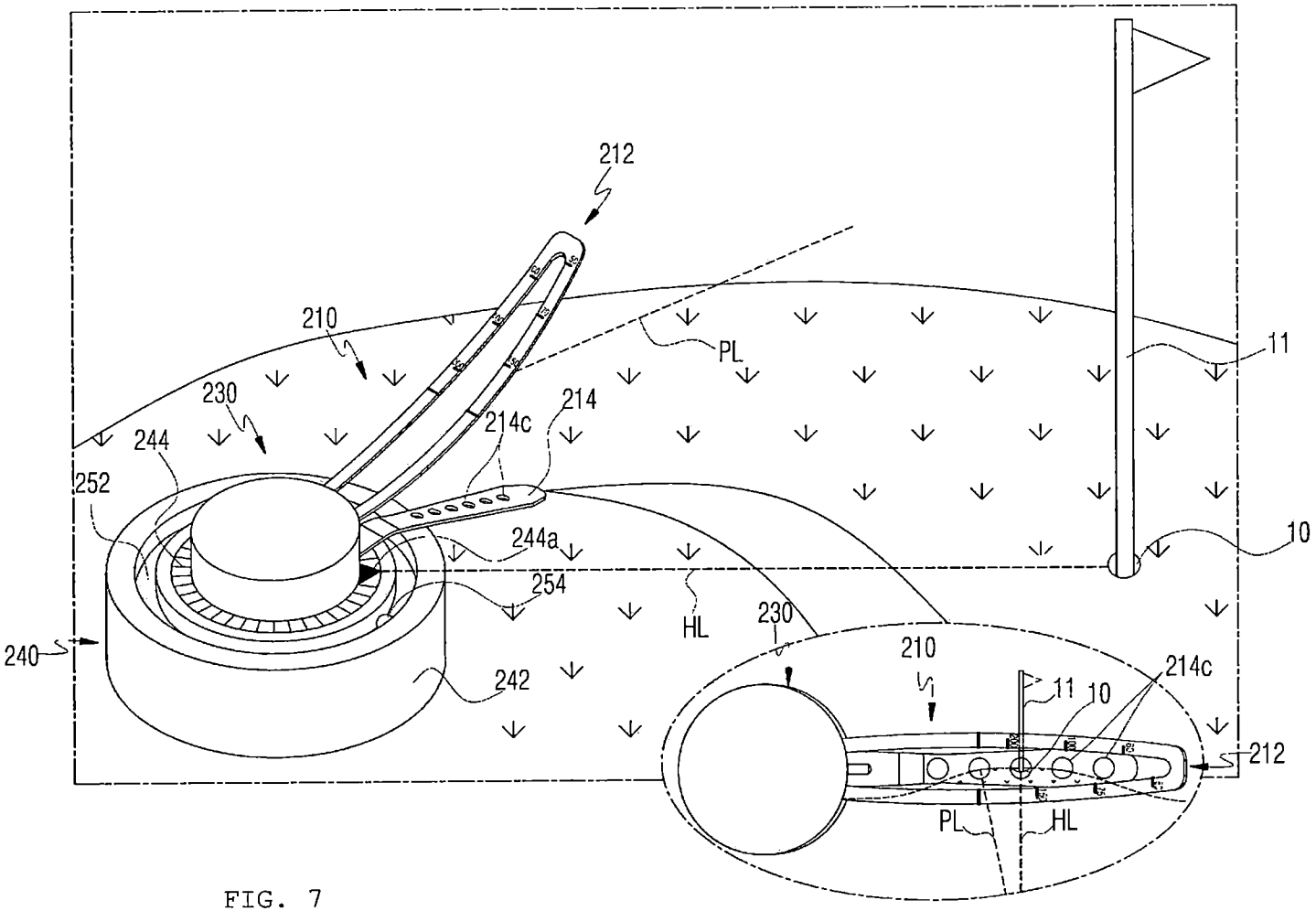
FIG. 7 is a view illustrating the state in which the golf ball marker of FIG. 3D is used in a green.

FIG. 1A is a perspective view of a golf ball marker having a clip part according to a first embodiment of the present disclosure, FIG. 1B is a perspective view of a first modification of the golf ball marker of FIG. 1A, FIG. 1C is a perspective view of a second modification of the golf ball marker of FIG. 1A, FIG. 2A illustrates states in which the golf ball marker of FIG. 1A is worn, FIG. 2B is a view illustrating the state in which the golf ball marker of FIG. 1A is installed and fixed in the vertical direction with respect to a green, FIG. 3A is a perspective view of a golf ball marker having a clip part according to a second embodiment of the present disclosure, FIG. 3B is a perspective view of a first modification of the golf ball marker of FIG. 3A, FIG. 3C is a perspective view of a second modification of the golf ball marker of FIG. 3A, FIG. 3D is a perspective view of a third modification of the golf ball marker of FIG. 3A, FIG. 4 is a view illustrating the state in which the golf ball marker of FIG. 3A is used in a green, FIG. 5 is a view illustrating the state in which a distance to a hole cup is roughly measured using the golf ball marker of FIG. 3B, FIG. 6 is a view illustrating the state in which the golf ball marker of FIG. 3C is used in a green, and FIG. 7 is a view illustrating the state in which the golf ball marker of FIG. 3D is used in a green.

Upper (upper side), lower (lower side), left and right (side or lateral side), front (front side), rear (rear side), and the like designating directions in the description of disclosure and the claims are determined based on the relative positions between drawings or components for convenience of explanation, rather than limiting the scope of protection. Each of the directions described below is based on this, unless otherwise specifically limited.

A golf ball marker 100 or 200 having a clip part according to the present disclosure includes a marker and an attachment part, which are integrated with each other in order to improve upon the inconvenience of a conventional coin type marker, which is attached to a separate attachment part and is then attached to a belt or the like. This integration is intended to improve portability and convenience of the golf ball marker 100 or 200.

In addition, the golf ball marker 100 or 200 of the present disclosure has been conceived in order to solve the problem that the conventional coin type markers are poor in visibility at a point where the position of the golf ball is indicated due to the thin thickness thereof, through the fundamental and simple change of conception (for each of the following components), and to enable immediate acquisition of information necessary for rounding.

First Embodiment

In order to execute the functions or actions described above, as illustrated in FIG. 1A, a golf ball marker 100 having a clip part according to a first embodiment of the present disclosure includes a clip part 110 and fixing portions 120*a* and 120*b*, and further includes an indication part 130 for ensuring visibility.

Each of the above-described configurations will be described in detail as follows.

The clip part 110 is a component configured to be rapidly fixed to a fixed portion such as a pocket, a belt, a visor, or head and used as a means for indicating the position of a golf ball by being rapidly detached from the fixed portion, and includes a curved elastic body 112, a pressing piece 114, etc.

The curved elastic body 112 is a component bent in a bow shape in which a curved shape is reversed in opposite directions due to an external force to exert an elastic force, and includes a pair of elastic pieces 112*a*, 112*b* spaced apart from each other such that a hollow portion S is disposed in the central portion therebetween and joined together in a twisted state at at least one of the opposite ends thereof so as to form a curved shape and to exert an elastic force corresponding to the degree of twist.

At this time, since the pair of elastic pieces 112*a* and 112*b* are joined together in the state of being twisted, a torsional stress is applied to the facing inner regions of the elastic pieces 112*a* and 112*b*, and when the curved elastic body 112 is deformed with an external force equal to or higher than the corresponding stress, the curved elastic body is bent in opposite directions while the twist direction is reversed with reference to the inner regions of the elastic pieces 112*a* and 112*b*, particularly the central portion.

The pressing piece 114 is a component that forms an insertion space I while being spaced apart from the curved elastic body 112 in the direction of moving away from the curved elastic body 112 in the state of being connected to one end of the curved elastic body 112, and that exerts a fixing force while being in compressive contact with the curved elastic body 112 when the curved elastic body 112 is bent and deformed in the direction in which the curved elastic body 112 approaches the pressing piece 114.

The pressing piece 114 is formed to be parallel to the longitudinal direction of the curved elastic body 112 to form the above-described insertion space I or to exert the fixing force and has a bent portion 114*a* concavely bent toward the curved elastic body 112 at the central portion thereof in order to increase the above-mentioned fixing force. The pressing piece 1143 is provided with at least one elongated hole such that, when the curved elastic body 112 is bent and deformed to approach the pressing piece 114, the pressing piece 114 can exert a soft elastic force. In addition, the width of the free end portion of the pressing piece 114 is preferably larger than the width of the hollow portion S such that the pressing piece 114 is not inserted into the hollow portion S.

The curved elastic body 112 and the pressing piece 114 may be integrally manufactured through a process of cutting and bending a plate-shaped metal member through press working, or may be integrally manufactured through injection molding using a synthetic resin.

A user may easily and rapidly attach or detach the golf ball marker 100 according to the present disclosure to or from a pocket or the like through the clip part 110 having the structure described above.

That is, the user may conveniently and easily carry the golf ball marker 100 according to the present disclosure in the state of being attached to a pocket, head, or the like by applying a unidirectional external to the curved elastic member 112 to form the insertion space I, then causing one side of a visor, a belt, or head as shown in FIG. 2A to be positioned in the insertion space I, and then applying an external force to the curved elastic body 112 in the other direction such that a fixing force is exerted by the pressing piece 114. Then, the user may remove the golf ball marker 100 according to the present disclosure in reverse order to the above-described method, and may use the golf ball marker 100 to indicate the position of the golf ball.

In addition, since the clip part 110 has a predetermined volume and is formed to be elongated in a direction, the clip part 110 may sufficiently perform a role similar to that of a conventional marker by itself. When the clip part 110 is positioned such that the free end side of the curved elastic body 112 and the pressing piece 114 (the side at which the clip part 110 is opened or closed) is directed to a hole cup 10 or a putting line PL while indicating the position at which the golf ball is placed, the putting play can be advanced quickly.

The fixing portion 120*a* or 120*b* is a component provided to allow the clip part 110 to be firmly fixed without moving on the ground of a golf course. The fixing portion 120*a* or 120*b* protrudes outward from one side of the clip part 110 and is formed in the form of a pile, a pin, or a T-shaped or V-shaped pack as a whole, so that the fixing portion can be smoothly driven into the ground.

According to the first embodiment of the present disclosure, as illustrated in FIGS. 1A and 2A, at least one fixing portion 120*a* or 120*b* protrudes outwards in the longitudinal direction of the clip part 110 from the connection portion 116 between the curved elastic body 112 and the pressing piece 114 such that the clip part 110 is installed and fixed in the vertical direction with respect to the ground of a golf course. In this case, it is preferable to provide four or fewer protruding fixing portions 120*a* and 120*b* in consideration of portability and visibility depending on the size of the clip part 110, and FIG. 1A illustrates one fixing portion 120*a*.

When the clip part 110 is fixed in the vertical direction with respect to the ground of the golf course through the fixing portion 120*a*, it is possible to firmly fix the position compared to the case in which a conventional coin type marker is placed on the ground. Further, since the clip part remarkably protrudes upwards from the ground of the golf course by the length thereof, visibility is greatly improved such that it is possible to immediately confirm the point where the position of the golf ball is indicated, and based on this, it is possible to quickly establish game plan or the like required for golfing.

The indication part 130 is a component included in the clip part 110 to improve the visibility of the clip part 110 installed on the ground of the golf course to indicate the position of the golf ball, and any indication part 130 may be used as long as it includes a combination of characterful, distinctive, and decorative shapes, patterns, features, and colors and can be installed in the clip part 110 to further improve the visibility as a marker.

However, the indication part 130 according to the first embodiment of the present disclosure has a predetermined character shape. At this time, the predetermined character shape includes shapes of an animal such as a bear or a dog, a shape of an insect such as a butterfly or a bee, a movie character shape, a cartoon character shape, a geometric decorative shape, or the like. This shape may be colored appropriately, and a shiny material may be used on the surface in order to create an elegant appearance and to improve visibility and decoration. For example, in FIGS. 1A and 2B, a character shape representing a butterfly is coupled to the upper surface of the clip part 110 to be used as the indication part 130.

With this character shape, the golf ball marker 100 according to the present disclosure can be fully utilized as an accessory by being attached to a body, clothes, or a bag due to the enhanced decorative function as well as the improved visibility for a golf ball position.

According to a first modification to the first embodiment of the present disclosure, as illustrated in FIG. 1B, at least one fixing portion 120*b* protrudes in the vertical direction with respect to the longitudinal direction of the clip part 110 from the pressing piece 114 such that the clip part 110 is installed and fixed in the horizontal direction with respect to the ground of a golf course. In this case, it is preferable to provide four or fewer protruding fixing portions 120*b* in consideration of portability and visibility depending on the size of the clip part 110, and FIG. 1B illustrates one fixing portion 120*b*.

When the clip part 110 is fixed in the horizontal direction with respect to the ground of the golf course through the fixing portion 120*b*, it is possible to firmly fix the position compared to the case in which a conventional coin type marker is placed on the ground. Further, since the clip part protrudes upwards from the ground of the golf course by the thickness thereof, visibility is improved such that it is possible to immediately confirm the point where the position of the golf ball is indicated, and based on this, it is possible to quickly establish a game plan or the like required for golfing.

As illustrated in FIG. 1B, on the surface of the elastic pieces 112*a* and 112*b* according to the first modification to the first embodiment of the present disclosure, distance-measuring scales 118 are formed which make it possible to measure the distance to the hole cup 10 based on the size of the hole cup flag 11 when the user looks at a hole cup flag 11 through the hollow portion S at a middle or long distance (about 50 m to 200 m, which is a distance for using a wood or a sand wedge).

In this case, each indication line of the distance measuring scales 118 forms an indication line for each distance using the similarity ratio of viewing angles each forming a triangular shape as illustrated in FIG. 5. That is, based on the length of the hole cup flag 11 (h1, approximately 170 cm) and the spacing distance h2 between the user's eye and the clip part 110 or 210 (arbitrarily set to about 30 cm to 90 cm), correlation (x, y) between the inter-scale length (an unknown x) and the distance to the hole cup 10 (an unknown number y) can be calculated through the calculation of a proportional equation. Since the calculation of the proportional equation is simple, a detailed explanation thereof will be omitted.

A method of using the distance measurement scales 118 or 218 formed on the elastic pieces 112*a* and 112*b* or 212*a* and 212*b* will be briefly described with reference to FIG. 5. First, an end portion (upper end portion or lower end portion) of the clip part 210 or the indication part 230 is lightly held, and the distance between the user's eye and clip part 210 (h2) is adjusted to a preset distance (arbitrarily set to about 30 cm to 90 cm) while adjusting the user's viewing angle such that the hole cup flag 11 is visible through the hollow portion S. Thereafter, the ground scale 218*a* formed at the lower end among the distance measurement scales 218 is aligned with the lower end of the hole cup flag 11, and then the distance to the hole cup 10 (y) is measured based on the scales (e.g., 50 m, 60 m, 75 m, 100 m, 150 m, and 200 m) formed in a region corresponding to the upper end of the hole cup flag 11, which is visible through the hollow portion S.

These distance measurement scales 118 or 218 are not able to accurately measure the distance to the hole cup 10 as precisely as a complicated and bulky electronic measurement device, but there is benefit in that the distance to the hole cup 10 can be immediately and intuitively measured by merely forming the distance measurement scales on the clip part 110 or 210 having a simple structure and a small volume.

As a result, since it is not necessary to carry an expensive measuring apparatus separately, it is possible to improve the user's convenience, and since immediate measurement is enabled whenever necessary, it is possible to make a quick decision on club selection and the like, thereby enhancing athletic performance. When the distance measurement scales 118 or 218 are indicated on the clip part 110 or 210, the indication part 130 or 230 is installed preferably to lean to the end of the clip part 110 or 210 so as not to interfere with the indication part 130 or 230.

In addition, as briefly illustrated in FIG. 1B, according to the first modification to the first embodiment of the present disclosure, one or more LED lamps 132 may be mounted on one side of the indication part 130 to be powered by a flat mercury battery 134, and an on/off switch 136 may be provided on one side of the surface of the indication part 130. The LED lamps 132 are provided to easily confirm or recognize a position where the golf ball is placed when the amount of sunshine is small, for example, on a cloudy day, early morning, or sunset.

Meanwhile, as illustrated in FIG. 1C, according to a second modification to the first embodiment of the present disclosure, the clip part 110 includes a first hole cup sight 112*c*, which repeatedly protrudes from the elastic piece 112 to the hollow portion S in the longitudinal direction of the elastic piece 112. In this case, one protrusion of the first hole cup sight 112*c* corresponds to one hole cup number.

At this time, hole cup number refer to a method of numerically expressing a putting-target point determined by an advisor such as a caddy on the basis of a hole cup 10.

The first hole sight 112*c* allows the user to easily set a putting line PL in accordance with the hole cup number determined depending on the lie of a green in the golf course, thereby providing the user with the convenience in landing upon the green. Here, the term "lie" is a term that encompasses conditions related to a position where a golf ball is stopped on a field, and the field is variously utilized on the basis thereof.

The usage of the first hole cup sight 112*c* will be described with reference to an enlarged view of FIG. 7. First, the user places the golf ball marker 110 according to the present disclosure in a lateral direction such that the hole cup 10 is correctly positioned between the protrusions formed on the first hole cup sight 112*c*. Then, it is possible to simply indicate or set a putting line PL on the green by remembering the approximate angle between the position of a protrusion shifted by the hole cup number determined by a caddy or the user based on the lie of the green of the golf course (i.e., the putting line PL) and the position of the hole cup 10 (the hole cup line HL), and causing the clip part 110 to be directed to the corresponding angle while positioning the golf ball marker 100 according to the present disclosure at a position where the golf ball has been placed.

Second Embodiment

As illustrated in FIG. 3A, a golf ball marker 200 having a clip part according to a second embodiment of the present disclosure includes a clip part 210 and a coin-shaped indication part 230 provided on the clip part 210. Here, since the clip part 210 and the indication part 230 are similar to those described in the first embodiment, a detailed description thereof will be omitted, and only the distinctive differences therebetween will be briefly described.

First, the indication part 230 according to the second embodiment of the present disclosure is manufactured in a conventionally used coin shape and is installed at one end of the clip part 210 in order to further improve the visibility of the clip part 210. At this time, a variety of patterns, and characters may be formed on the coin-shaped indication part 230 together with colors.

As illustrated in FIG. 4, when the golf ball marker 200 having a simple structure and shape according to the second embodiment of the present disclosure is horizontally placed on the ground of a golf course such that the longitudinal direction of the clip part 210 is directed to the hole cup 10 after deforming and bending the clip part 210 to be bent upwards, the visibility is improved due to the clip part 210, which is deformed and bent upwards, so that a point where the position of the golf ball is indicated and the hole cup line HL can be immediately confirmed and a strategy necessary for rounding can be quickly established based thereon. In addition, since it is easy to pick up the clip part 210, which is deformed and bent upwards, it is easy to recover the golf ball marker 200 according to the present disclosure.

Meanwhile, as illustrated in FIG. 3B, the golf ball marker 200 according to the first modification to the second embodiment of the present disclosure may further include fixing portions 220*a* and 220*b* for securing a firm fixing force to the ground of the golf course, distance measuring scales 218, a bottom support 240 configured to provide direction indication and inclination information, an LED lamp 232, and the like.

Here, since the fixing portions 220*a* and 220*b* and the distance measurement scales 218 are similar to those described in the first embodiment, a detailed description thereof will be omitted, and only the distinctive differences therebetween will be briefly described.

First, one or more fixing portions 220*b* protrude in the vertical direction with respect to the longitudinal direction of the clip part 210 from the bottom surface of the indication part 230 such that the clip part 210 is installed and fixed in the horizontal direction with respect to the ground of the golf course. Although not illustrated in FIG. 3B, of course, one or more fixing portions 220*a* may be provided on the outer peripheral surface of the indication part 230 to protrude in the longitudinal direction of the clip part 210 such that the clip part 210 is installed and fixed in the vertical direction with respect to the ground of the golf course.

As illustrated in FIG. 3B, according to the first modification to the second embodiment of the present disclosure, the indication part 230 may include a distance measurement sensor 238 mounted on one side (preferably, on the clip part 210 side) in order to easily determine the distance to the hole cup 10 in a short distance (about 20 m). In the state of being mounted at appropriate positions exposed to the outside as in the first embodiment, one or more LED lamps 132 or 232 are implemented to change colors depending on the distance to the hole cup 10 (e.g., 20 m, 15 m, 10 m, 5 m, and 3 m) in cooperation with the sensor measurement sensor 238.

The distance measurement sensor 238 and the LED lamp 232 may be powered by a flat mercury battery 234, and an on/off switch 236 may be provided on one side of the indication part 230. The LED lamp 232 may facilitate grasping the position of the golf ball even when the amount of sunshine is small, for example, on a cloudy day, early morning, or sunset. At the same time, the LED lamp 232 may immediately provide information on the distance to the hole cup 10 to the user through an intuitive color change.

Meanwhile, according to a second modification of the second embodiment of the present disclosure, the golf ball marker 200 may further include a bottom support 240, as illustrated in FIG. 3C. The bottom support 240 is detachably coupled to the indication part 230 of the golf ball marker 200 according to the second embodiment described above to perform additional functions. The bottom support 240 includes a body 242, stroke scales 244, and a magnetic body 246.

The body 242 is a disc-shaped component having an accommodation groove 242*a* formed at a central portion thereof so as to pivotally accommodate the indication part 230 therein. At this time, an inclined direction indication part 250 including an annular groove 252 and a luminous ball 254 may be further provided on the top surface of the body 242, so that the inclined direction of the green can be immediately and intuitively recognized.

The annular groove 252 is a component that is formed in a ring shape along the outer periphery of the accommodation groove 242*a* in an upwardly opened state. In the opened region, a cover ring made of a transparent material may be provided to cover the opened region so as to prevent the luminous ball 254, which will be described later, from escaping from the accommodation groove 242*a*. Alternatively, escape prevention protrusions protruding from one side of the opened region toward the center of the opened region may be formed.

The luminous ball 254 is a component that indicates the inclined direction while moving due to its own weight in the state of being accommodated in the annular groove 252, and is manufactured as a spherical member having a diameter smaller than the width of the annular groove 252. The user is able to intuitively and clearly confirm the inclined direction of the golf course even when the amount of sunshine is small, for example on a cloudy day, early morning, or sunset, through the luminous component of the luminous ball 254.

The inclined direction indication part 250 described above immediately and clearly provides information on the inclined direction in golf rounding in which an immediate determination is important, thereby contributing to grasping the flow or lie of the green, and hence helping enhancing rounding convenience and athletic performance.

The stroke scales 244 are provided to indicate the rotation degree of the clip part 210, which is positioned to indicate the stroke direction of a putter, with respect to the hole cup 10, in which the stroke direction is determined depending on the lie of the green of the golf course, and the stroke scales 244 are formed on the top surface of the body 242 at regular intervals along the edge of the accommodation groove 242*a*. In this case, for example, 36 stroke scales 244 in total may be provided such that each stroke interval indicate 10 degrees, and a hole cup scale 244*a* may be provided at any one side to be distinguished from other scales.

The method of using the stroke scales 244 is executed such that the bottom support 240 is placed on the ground of the golf course such that the hole scale 244*a* of the lower support 240 is directed to the hole cup line HL as illustrated in FIG. 6, and the indication part 230 is rotated such that the longitudinal direction of the clip part 210 and the putting line PL determined depending on the lie of the green (usually determined by degrees from the hole cup 10 to the left or right) coincide with each other.

When the longitudinal direction of the clip part 210 indicates the putting line PL visually clearly, actual putting may be immediately performed, and an own putting line PL may be modified or changed appropriately on the basis of the previously performed putting.

The magnetic body 246 is provided to allow the metal indication part 230 to be maintained at a rotated state without being easily separated from the bottom support 240. The magnetic body 246 is embedded in the center of the accommodation groove 242*a* to fix the indication part 230 with a magnetic force.

As illustrated in FIG. 3D, according to a third modification to the second embodiment of the present disclosure, the clip part 210 includes a second hole cup sight 214*c* consisting of circular, elliptical, or polygonal perforations, which are arranged at regular intervals in the central portion of the pressing piece 214 in the longitudinal direction thereof. At this time, the space between the perforations of the second hole cup sight 214*c* and one perforation corresponds to one hole cup number. Of course, the second hole cup sight 214*c* may be used in combination with the first hole cup sight 112*c* described above in the first and second embodiments.

Like the first hole cup sight 112*c*, the second hole sight 214*c* allows the user to easily set a putting line PL in accordance with the hole cup number determined depending on the lie of a green in the golf course, thereby providing the user with the convenience in landing upon the green.

The usage of the second hole cup sight 214*c* will be described with reference to an enlarged view of FIG. 7. First, the user places the golf ball marker 100 according to the present disclosure in a lateral direction such that the hole cup 10 is correctly positioned in a perforation formed in the second hole cup sight 214*c*. Then, it is possible to simply indicate or set a putting line PL on the green by remembering the approximate angle between the position of a perforation or a space between perforation shifted by the hole cup number determined by a caddy or the user based on the lie of the golf green (i.e., the putting line PL) and the position of the hole cup 10 (the hole cup line HL) and causing the clip part 110 to be directed to the corresponding angle while positioning the golf ball marker 100 according to the present disclosure at a position where the golf ball has been placed.

In addition, when the golf ball marker 200 according to the third modification to the second embodiment of the present disclosure is used together with the bottom support 240, the putting line PL may be simply indicated or set on the green by causing the hole cup scale 244*a* to be directed to the hole cup line HL, then remembering the approximate angle between the putting line PL and the hole cup line HL through the second hole cup sight 214*c*, and then seating the golf ball marker 100 in the accommodation groove 242*a* while positioning the clip part 210 so as to reflect the angle with respect to the hole cup scale 224*a*.

Of course, among the components described in the second embodiment of the present disclosure, any component, which has not been described in the first embodiment, is capable of being applied to the first embodiment.

Although the specific embodiment of the present disclosure has been described above, it is apparent to those skilled in the art that the present disclosure is not limited to the embodiment disclosed herein and various modifications and changes can be made without departing from the spirit and scope of the present disclosure. Therefore, such modifications and changes should not be individually construed from the spirit or point of view of the present disclosure, and it should be understood that modified embodiments belong to the claims of the present disclosure.

INDUSTRIAL APPLICABILITY

According to a golf ball marker having a clip part according to the present disclosure, since a clip part, which can be easily and quickly attached to or detached from on a fixed portion such as a pocket, a belt, a visor, or head, and which can be used for indicating the position of a golf ball by itself, is provided, the convenience in carrying and use is improved. Since the longitudinal direction of the clip part is firmly fixed in the vertical direction as well as the horizontal direction with respect to the ground of the golf course, the visibility of the position of the golf ball is improved even at a long distance, thereby improving the rounding convenience and athletic performance. By overcoming the limit of the existing technique in this way, the present disclosure can be used in the related art, and the possibility of commercialization or marketing of apparatuses to which the present disclosure is applied is sufficient. Further, it is clear that the present disclosure can be practically executed. Thus, the present disclosure is an industrially available disclosure.

The invention claimed is:

1. A golf ball marker comprising:

a clip part comprising an elastic clip body and a pressing piece, wherein the elastic clip body is in a curved shape and elastically deformable in response to an external force applied thereto, wherein the pressing piece is connected to an end of the elastic clip body to be spaced apart from the elastic clip body or to come into compressive contact with the elastic clip body, the clip part being selectively attached to or detached from a fixed portion and being used as a marker; and a fixing portion protruding from one side of the clip part to fix the clip part to a ground of a golf course, wherein the elastic clip body comprises a pair of elastic pieces disposed to be spaced apart from each other to form a hollow portion therebetween, the pair of elastic pieces joining at at least one end thereof to form the curved shape, and wherein the pair of elastic pieces comprises distance measurement scales formed on a surface thereof, so that a user is able to measure a distance to a hole cup based on a size of a hole cup flag when the user looks at the hole cup flag through the hollow portion at a middle or long distance.

2. The golf ball marker of claim 1, wherein the fixing portion is configured such that:

at least one fixing portion protrudes outwards from a connection portion between the elastic clip body and the pressing piece in a longitudinal direction of the clip part such that the clip part is installed and fixed in a vertical direction with respect to the ground of the golf course; or at least one fixing portion protrudes from the pressing piece in a vertical direction with respect to a longitudinal direction of the clip part such that the clip part is installed and fixed in a horizontal direction with respect to the ground of the golf course.

3. The golf ball marker of claim 1, further comprising:

an indication part coupled to the elastic clip body of the clip part to improve visibility of the clip part installed on the ground of the golf course to indicate a position of a golf ball, wherein the indication part is formed in a character shape obtained by representing an insect or an animal.

4. The golf ball marker of claim 3, wherein the indication part has an LED lamp mounted on one side thereof.

5. A golf ball marker comprising:

a clip part comprising an elastic clip body and a pressing piece, wherein the elastic clip body is in a curved shape and elastically deformable in response to an external force applied thereto, wherein the pressing piece is connected to an end of the elastic clip body to be spaced apart from the elastic clip body or to come into compressive contact with the elastic clip body, the clip part being selectively attached to or detached from a fixed portion and being used as a marker; and a coin-shaped indication part provided on the clip part to improve visibility of the clip part installed on a ground of a golf course to indicate a position of a golf ball, wherein the elastic clip body comprises a pair of elastic pieces disposed to be spaced apart from each other to form a hollow portion therebetween, the pair of elastic pieces joining at at least one end thereof to form a curved shape, and wherein the elastic pieces have distance measurement scales formed on a surface thereof, so that a user is able to measure a distance to a hole cup based on a size of a hole cup flag when the user looks at the hole cup flag through the hollow portion at a middle or long distance.

6. The golf ball marker of claim 5, further comprising:

a fixing portion coupled to the clip part to fix the clip part to the ground of the golf course, wherein the fixing portion is configured such that:

at least one fixing portion protrudes outwards from an outer peripheral surface of the indication part in a longitudinal direction of the clip part such that the clip part is installed and fixed in a vertical direction with respect to the ground of the golf course; or at least one fixing portion protrudes from a bottom surface of the indication part in a vertical direction with respect to a longitudinal direction of the clip part such that the clip part is installed and fixed in a horizontal direction with respect to the ground of the golf course.

7. The golf ball marker of claim 5, wherein the indication part has an LED lamp mounted on one side thereof.

8. The golf ball marker of claim 5, further comprising:

a bottom support detachably coupled to the indication part, wherein the bottom support comprises:

a body having an accommodation groove formed to pivotally accommodate the indication part therein;

stroke scales formed on a top surface of the body along an edge of the accommodation groove in order to indicate a rotation degree of the clip part with respect to a hole cup in a state in which the clip part is positioned to indicate a stroke direction of a putter determined depending on a lie of a green of the golf course; and a magnetic body embedded in a center of the accommodation groove to fix the indication part with a magnetic force.

9. The golf ball marker of claim 8, wherein the body further comprises an inclined direction indication part on a top surface thereof so as to allow an inclined direction of the green to be intuitively recognized, and the inclined direction indication part comprises:

an annular groove formed in a ring shape along an edge of the accommodation groove in a state of being opened upwards; and a luminous ball configured to move due to its own weight in a state of being accommodated in the annular groove and to indicate the inclined direction.

10. The golf ball marker of claim 4, wherein the indication part has a distance measurement sensor mounted on one side thereof so as to allow a distance to a hole cup within a short distance to be easily determined, and the LED lamp changes a color thereof depending on the distance to the hole cup in cooperation with the distance measurement sensor.

11. A golf ball marker comprising:

a clip part comprising an elastic clip body and a pressing piece, wherein the elastic clip body is in a curved shape and elastically deformable in response to an external force applied thereto, wherein the pressing piece is connected to an end of the elastic clip body to be spaced apart from the elastic clip body or to come into compressive contact with the elastic clip body, the clip part being selectively attached to or detached from a fixed portion and being used as a marker; and a fixing portion protruding from one side of the clip part to fix the clip part to a ground of a golf course, wherein the elastic clip body comprises a pair of elastic pieces disposed to be spaced apart from each other to form a hollow portion therebetween, the pair of elastic pieces joining at at least one end thereof to form the curved shape, wherein the clip part comprises at least one of:

a first hole cup sight having protrusions repeatedly protruding from an elastic piece along a longitudinal direction thereof towards the hollow portion so as to set a putting line depending on a hole cup number determined depending on a lie of a green of the golf course; and a second hole cup sight having circular, elliptical, or polygonal perforations arranged at equal intervals in a central portion of the pressing piece in a longitudinal direction thereof.

12. The golf ball marker of claim 7, wherein the indication part has a distance measurement sensor mounted on one side thereof so as to allow a distance to a hole cup within a short distance to be easily determined, and the LED lamp changes a color thereof depending on the distance to the hole cup in cooperation with the distance measurement sensor.

13. The golf ball marker of claim 5, wherein the clip part comprises at least one of:

a first hole cup sight having protrusions repeatedly protruding from an elastic piece along a longitudinal direction thereof towards the hollow portion so as to set a putting line depending on a hole cup number determined depending on a lie of a green of the golf course; and a second hole cup sight having circular, elliptical, or polygonal perforations arranged at equal intervals in a central portion of the pressing piece in a longitudinal direction thereof.

* * * * *